US006150914A

United States Patent [19]

Borho et al.

[11] Patent Number: 6,150,914

[45] Date of Patent: Nov. 21, 2000

[54] TRANSFORMER WITH DIVIDED PRIMARY WINDING USED IN A BLOCKING-OSCILLATOR SUPPLY CIRCUIT

[75] Inventors: Lothar Borho, Willstaett; Robert Kern, Sasbachwalden; Johann Freundorfer, Bogen, all of Germany

[73] Assignee: Robert Bosch GmbH, Stuttgart, Germany

[21] Appl. No.: 09/077,705

[22] PCT Filed: Sep. 19, 1996

[86] PCT No.: PCT/DE96/01774

§ 371 Date: Mar. 3, 1999

§ 102(e) Date: Mar. 3, 1999

[87] PCT Pub. No.: WO97/21232

PCT Pub. Date: Jun. 12, 1997

[30] Foreign Application Priority Data

Dec. 5, 1995 [DE] Germany ..... 195 45 304

[51] Int. Cl.[7] ..... H01F 27/28

[52] U.S. Cl. ..... 336/180; 336/182; 336/185; 336/198; 336/208

[58] Field of Search ..... 336/208, 198, 336/180, 182, 178, 183, 185

[56] References Cited

U.S. PATENT DOCUMENTS

| | | | |
|---|---|---|---|
| 3,638,155 | 1/1972 | Van . | |
| 4,305,056 | 12/1981 | Mochida et al. | 336/178 |
| 4,500,833 | 2/1985 | Napp et al. | 323/359 |
| 4,639,706 | 1/1987 | Shimizu | 336/170 |
| 5,576,681 | 11/1996 | Sander et al. | 336/208 |
| 5,696,477 | 12/1997 | Yamamori et al. | 336/192 |
| 5,751,205 | 5/1998 | Goseberg | 336/178 |
| 5,754,087 | 5/1998 | Goseberg | 336/178 |

FOREIGN PATENT DOCUMENTS

| | | | |
|---|---|---|---|
| 309 837 | 4/1989 | European Pat. Off. . | |
| 365 407 | 7/1990 | France | 336/182 |
| 18 02 830 | 5/1970 | Germany . | |
| 18 16 345 | 7/1970 | Germany . | |
| 2216729 | 10/1989 | United Kingdom . | |

OTHER PUBLICATIONS

"Transformatoren für Schaltnetzteile [Transformers for switched–mode power supply units]", Klaus Mock, *Elektronik*, Nov. 23, Nov. 16, 1993, pp. 46–50.**

*Primary Examiner*—Michael L. Gellner
*Assistant Examiner*—Anh Mai
*Attorney, Agent, or Firm*—Kenyon & Kenyon

[57] ABSTRACT

A transformer includes a divided primary winding in an isolating transformer power supply circuit and a secondary winding between the parts of the primary winding, a magnetic core having an air gap, and a bobbin surrounding the core with the individual windings applied to it, the transformer has a row of terminal posts to which the windings are connected is designed so that the primary winding is divided into at least three partial windings. The, the secondary winding that is under the highest load for the longest period of time is divided into at least two partial windings, the partial windings of this load secondary winding are enclosed by two partial windings of the minimum of three partial windings of the primary winding on the bobbin, and optionally one or more additional secondary windings are arranged outside the winding structure of the partial windings of the primary winding and load secondary winding.

17 Claims, 2 Drawing Sheets

TRANSFORMER WITH DIVIDED PRIMARY WINDING USED IN A BLOCKING-OSCILLATOR SUPPLY CIRCUIT

FIELD OF THE INVENTION

The present invention relates to a transformer with a divided primary winding in an isolating transformer power supply circuit.

An article by Klaus Mock, "Transformatoren für Schaltnetzteile" (Transformers for Switched-Mode Power Supply Units in *Elektronik,* No. 23, Nov. 16, 1993, pages 46–50 describes various transformers suitable for switched-mode power supply units for isolating transformers. In general, such transformers are widely used in consumer electronics because of their relatively simple design, even in the case of multiple output voltages. The essential functions of a transformer in a switched-mode power supply include transformation of one voltage into one or more other voltages and electrical isolation of multiple circuits. However, an actual transformer also produces a power loss which in turn leads to heating of core and winding in particular. The various windings are arranged on a bobbin which surrounds the magnetic core with the air gap contained therein. The ends of the individual windings lead to a number of terminal posts, where they are connected electrically and secured.

In the vicinity of the air gap, some of the magnetic flux does not pass through the cross-sectional area of the core but instead through the ambient air and the various windings, inducing eddy currents there. These often cause much greater losses than the skin effect and the proximity effect. The aforementioned article proposes a sandwich structure to reduce the leakage inductance in transformers of this type, wherein the primary winding is divided into two halves, and the secondary winding is enclosed between these two halves. This thus requires at least two, usually three main insulations, which are quite expensive.

With regard to specific applications of such transformers, e.g., in power supply circuits for high-pressure gas discharge lamps which are used preferentially in automotive headlights, the transformers known from the article cited above are not satisfactory because the losses are too high, the design is often very complex, and they have not been optimized to the demands of the power supply circuit.

SUMMARY OF THE INVENTION

The transformer according to the present invention with a divided primary winding has the advantage over the related art of especially close coupling of the primary winding and the load secondary winding with improved efficiency and the possibility of optimized tuning of core losses and winding losses so that no significant temperature gradient develops between core and winding. The transformer designed according to the present invention permits an optimized, simple and inexpensive design and thus favorable manufacturing. In addition, it can be adapted to a wide variety of application profiles.

According to the present invention, this is achieved in principle by dividing the primary winding into at least three partial windings; the secondary winding under the greatest power load for the longest period of time is divided into at least two partial windings; the partial windings of this load secondary winding are each enclosed by two partial windings of the at least three partial windings of the primary winding on the bobbin; and optionally one or more additional secondary windings are arranged outside the winding structure of the partial windings of the primary and load secondary windings.

In an especially exemplary embodiment according to the present invention, the at least three partial windings of the primary winding are connected in parallel externally. In a further exemplary embodiment according to the present invention, the at least two partial windings of the load secondary winding are connected in parallel internally.

According to a very advantageous exemplary embodiment of the present invention, no turns of the winding are provided in the area above the air gap. This greatly reduces the influence of the stray field there on the windings and also significantly decreases the eddy currents generated in the turns of the windings.

In an advantageous ememplary embodiment according to the present invention, the bobbin is provided with two chambers separated by a partition over the area of the air gap. The individual turns of the various windings are thus mounted on the bobbin in a simple manner, except in the area of the air gap. This is advantageous for economical and inexpensive production in particular, apart from the resulting safety measure that there are no turns in the area of the air gap in which eddy currents could be induced by the stray field of the air gap. According to an ememplary embodiment of this advantageous design of the bobbin, passages for the wires of the windings are provided in the partition separating the chambers, leading from one chamber into the other.

In another advantageous exemplary embodiment according to the present invention, a part, preferably one-half, of each partial winding of the primary winding and/or the load secondary winding is provided on one side, and a part, preferably also one-half, is provided on the other side of the air gap area or in one of the chambers of the bobbin. This yields an advantageous symmetrical and balanced distribution of windings and turns over the length of the bobbin.

According to yet another advantageous exemplary embodiment of the present invention, a part, preferably one-half, of each additional secondary winding is provided on one side, and a part, preferably also one-half, is provided on the other side of the air gap area or in one of the chambers of the bobbin.

According to an especially advantageous ememplary embodiment of the present invention, the width of the chambers of the bobbin, the diameter of the winding wire used and the number of turns of the windings are adjusted to one another so that one complete layer of windings is assigned to a certain partial winding, and thus the entire chamber width is occupied. This measure yields a greatly reduced winding width. The turns are advantageously built up more in height over the bobbin and are arranged in layers.

In yet another especially advantageous exemplary embodiment according to the present invention which contributes significantly toward minimization of loss and also greatly simplifies manufacturing, all windings are wound with wire of a single wire gauge and/or they are stranded conductors.

According to another advantageous exemplary embodiment of the present invention, the leads of all windings are attached to the bobbin on one side, and the ends of the windings are arranged on the other side of the bobbin. Therefore, the a.c. voltage drop from one side to the other is kept as linear as possible, thereby minimizing the a.c. voltage load between the windings, which is harmful for the insulation.

According to another especially important exemplary embodiment of the present invention which serves to provide security against polarity reversal and thus is extremely important in practice, the terminal posts, which are arranged in two rows of equal number on opposite sides of the bobbin, are allocated to the leads and ends of the partial windings and the windings in such a way that the transformer with its terminal posts is protected against polarity reversal, and it can be used in a testing instrument in particular and/or in both layers in a circuitboard with protection against polarity reversal.

In an especially important further exemplary embodiment according to the present invention, the size of the magnetic core of the transformer and the electric resistance of the windings applied to the bobbin are adjusted to one another so that the thermal losses in the core and in the windings result in such heating of core and windings that there is no significant temperature gradient between core and windings.

The transformer designed according to the present invention can be adapted in a variety of ways and used accordingly. In an especially advantageous further exemplary embodiment according to the present invention, it is provided in particular for use in a power supply circuit of a high-pressure gas discharge lamp used preferably in automotive headlights. It is a very expedient and inexpensive part in such a power supply circuit when designed appropriately with multiple additional secondary windings.

DETAILED DESCRIPTION OF THE INVENTION

Figure 1:
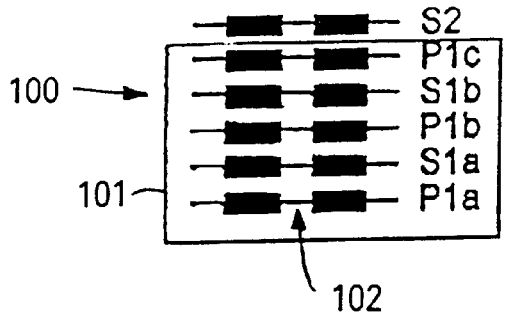
FIG. 1 shows a diagram of the interleaving according to the present invention in a first exemplary embodiment of a transformer with three partial windings on the primary side and two partial windings in the load secondary winding, and another secondary winding outside this structure.

FIG. 1 shows a schematic diagram of the interleaving according to the present invention in a first exemplary embodiment of a transformer with three partial windings on the primary side and two partial windings on the load secondary winding, plus another secondary winding outside this structure. A transformer 100 contains the interleaving of a primary winding P1 divided into three partial windings P1*a*, P1*b* and P1*c* within the area represented by a box 101 and a secondary winding S1 divided into two partial windings S1*a* and S1*b*.

The interleaving according to the present invention appears in general with the primary winding divided into at least three partial windings, and the secondary winding that is under the greatest load for the longest period of time, designated as the load secondary winding, divided into at least two partial windings. In order to obtain the closest coupling between these partial windings of primary winding P1 and load secondary winding S1, there are n partial windings of the primary winding versus n-1 partial windings of load secondary winding S1. The interleaving is performed so that one partial winding of the load secondary winding is enclosed by two partial windings of primary winding P1.

With the exemplary embodiment shown in FIG. 1, partial winding S1*a* of load secondary winding S1 is enclosed by partial windings P1*a* and P1*b* of primary winding P1, and second partial winding S1*b* of load secondary winding S1 is surrounded by partial windings P1*b* and P1*c* of the primary winding.

Outside this specific interleaving area 101, other secondary windings may optionally also be provided, as illustrated in FIG. 1 with a second secondary winding S2. These additional secondary windings are provided in general to generate other secondary voltages. These may be laid specifically in the area outside the interleaving and designed as undivided windings if they are needed only occasionally and in a less critical load range than load secondary winding S1 and the secondary voltage generated with it.

As also shown in FIG. 1 and indicated by arrow 102, each partial winding P1*a–c*, S1*a–b*, S2 is applied to the bobbin in such a way that a certain area above the air gap of the magnetic core does not have any turns of the windings. This minimizes induction current losses which can occur due the stray field, which is especially pronounced at the air gap. Due to the opening in the windings above air gap 102, the windings and partial windings are divided into two parts, preferably into two halves. To accomplish this in a manner that is reasonable and simple for manufacturing, the bobbin is provided with two chambers, preferably of equal length, as explained below in conjunction with FIGS. 5–7. One half of the respective winding or partial winding is placed in each chamber.

Figure 2:
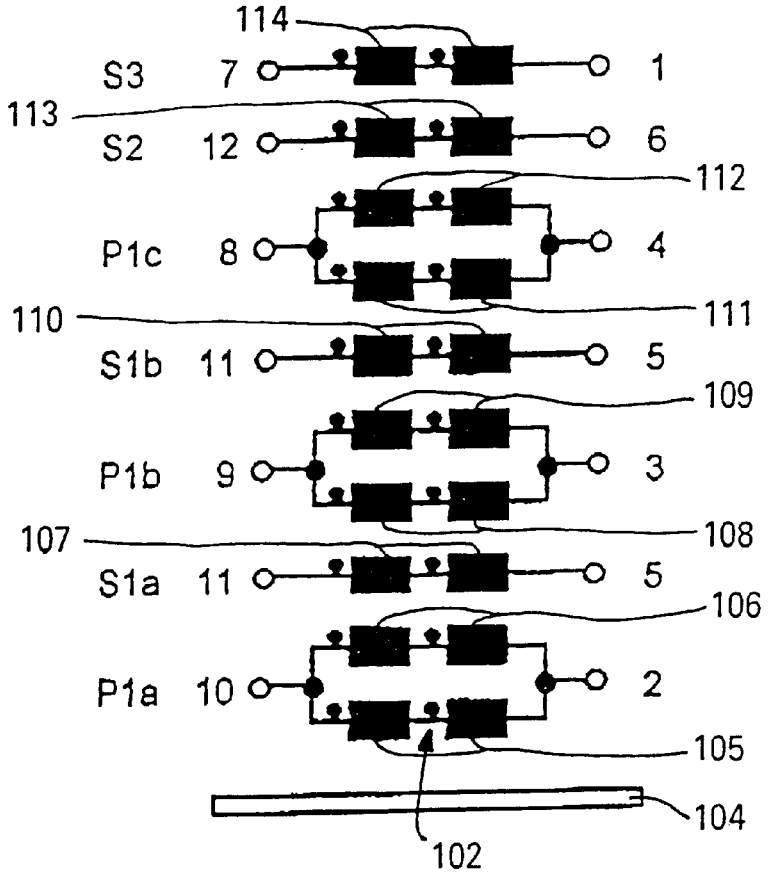
FIG. 2 shows a diagram of a second exemplary embodiment according to the present invention, showing the individual layers of the winding on the bobbin together with the assignment to the terminal posts, with a total of three windings being provided in the secondary circuit.

FIG. 2 shows a schematic diagram of a second exemplary embodiment according to the present invention, illustrating the individual winding layers on a bobbin 104 together with the assignment to terminal posts 1–12. Terminal posts 1–12 are arranged in two rows on opposite sides of the bobbin, for example. In this exemplary embodiment, a total of three windings S1, with S1*a* and S1*b*, S2 and S3 are provided on the secondary side. As seen from bobbin 104, the individual winding layers are applied to it first with an increasing diameter toward the outside and are then applied to the lower layers. In the example shown here, first partial winding P1*a* with a first layer 105 forms the bottom layer of the winding directly on bobbin body 104. This first winding layer 105 is provided twice, i.e., once in each chamber. The next winding layer 106 is applied to first winding layer 105. This is connected in parallel electrically to the first layer and is arranged between terminal posts 10 and 2. The points left of layers 105 and 106 as well as all other layers denote the leads of the windings. Winding layer 106 of first partial winding P1*a* of primary winding P1 is followed by a first winding layer 107 of first partial winding S1*a* of load secondary winding S1 between terminal posts 11 and 5. Further outward, this is followed in turn by two winding layers 108 and 109, which are connected in parallel electrically, between terminal posts 9 and 3. There then follows another winding layer 110 of second partial winding S1*b* of load secondary winding S1, which is also connected between terminal posts 11 and 5. Thus, both partial windings S1*a* and S1*b* of the load secondary winding are connected in parallel internally. This is followed by a first winding layer 111 of third partial winding P1*c*, and then another winding layer 112 in a parallel connection to winding layer 111 between terminal posts 8 and 4. Then another winding layer 113 of a second secondary winding S2 is applied to this winding layer, and then a winding layer 114 of a third secondary winding S3 is applied to this.

The arrangement of winding layers of different windings described above ensures an especially close coupling to primary winding P1 and its partial windings P1*a*–P1*c*, especially with regard to secondary winding S1 which is in continuous operation. This guarantees a good efficiency for the desired power transmission.

Figure 3:
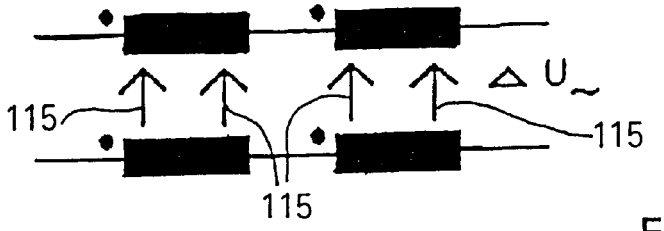
FIG. 3 shows a diagram of the arrangement of the winding leads on just one side of the bobbin, to achieve a linear a.c. voltage gradient.

In the diagram in FIG. 2 and in the other figures, the points next to the individual parts of the windings and/or the parts of the windings or the parts of the winding layers each represent winding leads. This is illustrated separately again in FIG. 3, with regard to the fact that the windings of the transformer design according to the present invention are arranged so that the winding leads are always applied to bobbin 104 on one side, e.g., at terminal posts 7–12 which are in a row as shown in FIG. 2, and the ends of the windings are always on the other side, e.g., at terminal posts 1–6 which are in the second row. This pursues the goal of keeping the a.c. voltage gradient ΔU~, represented by arrows 115, as linear as possible from one side to the other and thus minimizing the a.c. voltage load between the windings, which is harmful for the insulation.

Figure 4:
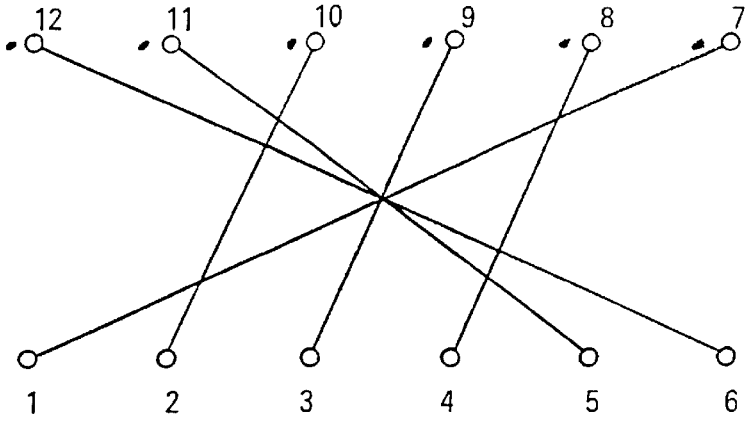
FIG. 4 shows a winding diagram with the respective terminal posts of a design of the transformer according to the present invention that is protected against polarity reversal.

FIG. 4 shows the winding diagram with the respective terminal posts of a transformer 100 designed according to the present invention with protection against polarity reversal. Terminal posts 1–12 are arranged in two rows 1–6 and 7–12 on opposite longitudinal sides of the bobbin, with 1 opposite 12 and 6 opposite 7. The individual windings are represented symbolically by marks between the terminal posts. To create an arrangement that is protected against polarity reversal, the three partial windings of primary winding P1 go from terminal post 10 to 2, from 9 to 3 and from 8 to 4, load secondary winding S1 goes from terminal post 11 to 5, secondary winding S2 goes from terminal post 12 to 6, and secondary winding S3 goes from terminal post 7 to terminal post 1. This assignment of terminal posts provides protection against polarity reversal and is optimal from a manufacturing standpoint. Thus, each winding can be tested separately in manufacturing, even if the transformer is inserted into the test adaptor with a 180° C. rotation. Likewise, it is harmless to install a transformer with this design into a circuitboard with either position 180° C. apart. The three partial windings P1*a*–*c* of the primary winding are connected in parallel externally, e.g., on the circuitboard.

A preferred exemplary embodiment of the transformer designed according to the present invention has three primary partial windings to be connected in parallel externally. Internally in each partial winding there are two winding layers connected in parallel. These measures greatly reduce the d.c. voltage resistance of this winding. Additionally, this preferred transformer has two partial windings S1*a*, S1*b* connected in parallel internally which are provided for the main power. Second secondary winding S2 is also provided as support for the main power, namely in the intended application case, when there is an increased power demand, and for decoupling capacitors for generating a negative output voltage. Third secondary winding S3 generates an auxiliary voltage which is needed only briefly and is then switched off.

In an advantageous manner, the transformer according to the present invention is wound with wire of a single wire gauge, which considerably simplifies manufacturing. It is also advantageous to use stranded wire. In the preferred exemplary embodiment, stranded 20×0.1 dia. HF wire is used.

To further simplify manufacturing and to reduce losses on the one hand while also increasing the coupling of the windings on the other hand, the width of the bobbin chambers, the wrapping wire diameter, and the number of turns of the windings and partial windings are adjusted to one another so that a complete layer or an integer multiple thereof (see winding layers 105–114 in FIG. 2) are assigned to a certain winding or partial winding and are thus wound over the width of a chamber. In the exemplary embodiment shown in FIG. 2, each of winding layers 105–112 contains 3+3 turns, for example, winding layers 113 and 114 each contain 6+6 turns, so that two layers of one winding are arranged directly above one another in each chamber there. This results in an expedient manner in a reduction of the width of the winding because it is wound in height. Since the intermediate insulation can be omitted, there is good coupling of the individual windings, in particular with the windings for the main power, and no additional winding space is needed for it.

Due to the interleaving of windings P1 and S1 with their respective partial windings according to the present invention, as well as the internal and external electrical interleaving, this provides a good possibility of controlling the electric d.c. resistance. Due to the winding opening in the area over the air gap and the use of suitably dimensioned stranded HF wire, the a.c. losses can also be minimized and can be controlled and measured better, so the electrically induced loss which results in heating of the windings can be balanced to a certain extent with the loss occurring in the magnetic core of the transformer. A suitable choice of core size also permits core-side adjustment. The goal here is to achieve a balance between the thermal losses in the core and the thermal losses in the windings, which result in heating of the core and winding package, respectively, so that no significant temperature gradient can develop between the core and winding package. This prevents special loads that would otherwise occur.

The transformer designed according to the present invention is intended in particular for use in the power supply circuit or control circuit of a high-pressure gas discharge lamp. Such lamps are used increasingly in automobile headlights. These lamps require a special control for ignition, starting and operation, which thus makes high demands on the power supply circuit and control circuit.

These demands include, for example, the fact that the control unit should operate satisfactorily in the temperature range of −40° C. to +105° C. (in quiescent air), with a temperature of up to 125° C. being allowed inside the control unit where the transformer is accommodated, and the transformer should also function satisfactorily despite its intrinsic heating. The good design of the transformer achieved according to the present invention with an efficiency of more than 90% makes it possible to use the control unit under severe use conditions. Thus, the control unit can be operated even at a very low battery voltage. Ignition of the lamp is possible at a battery voltage of only $U_{bat}$=7.0 V at the control unit input, starting operation of the lamp is possible between $U_{bat}$=7.0 V to 6.0 V at a control unit power output in the range of <85 W 35 W, and burning operation is possible at $U_{bat}$=6.0 V with a power output of 35 W.

With such low battery voltage conditions, it is ensured that the power consumption by the control unit will not exceed a certain level. The transformer does not exhibit any saturation phenomena.

The transformer designed according to the present invention is connected externally. Therefore, the voltages generated by it are made available to the corresponding parts of the circuit, e.g., high voltage for ignition of the lamp, low voltage for starting and medium voltage for operation.

Figure 5:
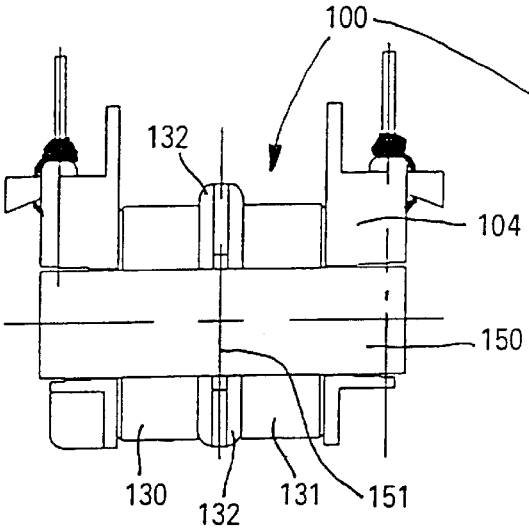
FIG. 5 shows an end view of the transformer according to the present invention.
Figure 6:
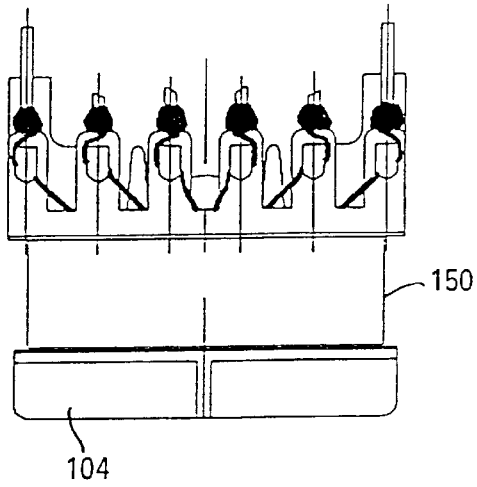
FIG. 6 shows a long side view of the transformer according to the present invention.
Figure 7:
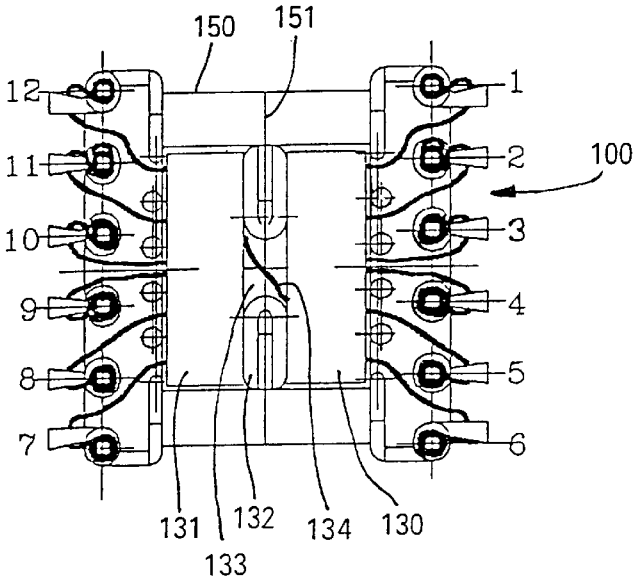
FIG. 7 shows a side view with the terminal posts of the transformer according to the present invention.

A special exemplary embodiment of transformer 100 designed according to the present invention is shown in three orthogonal views in FIGS. 5 through 7. FIG. 5 shows transformer 100 from one end, FIG. 6 from a long side and FIG. 7 from above, i.e., from the side on which terminal posts 1 through 6 and 7 through 12 are mounted in two rows along the long sides of bobbin 104. Bobbin 104 has two chambers 130 and 131, which are formed by a partition 132. Partition 132 is arranged in the area of the air gap of magnetic core 150 and ensures that no windings can be placed above the air gap, which is covered by bobbin 104 and therefore cannot be seen in FIGS. 5–7. Magnetic core 150 is composed of two E-shaped halves which abut against one another at faces 151 in the magnetic return circuit. The parts are glued together so that they will hold together after wound bobbin 104 has been pushed onto the middle part of core 150. This is done in particular in the middle area, which contains the air gap and is inside the part of bobbin 104 that has the windings. Due to partition 132, which may be approximately 3 mm thick, there are no windings over the air gap. Between chambers 130 and 131 there is a passage 133 through which winding wires 134 can be led from one chamber into another. It is expedient to have all such crossovers in a single passage, because then there is the fewest intersections of the stray field over the air gap. The turns themselves of the individual windings run parallel to two rows 1–6 and 7–12 of the terminal posts. The type and size of core 150 may be an EF25, for example, and it may be ground on one side. The measured intrinsic heating in continuous operation at 35 W with a battery voltage considerably lower than the nominal voltage, e.g., 13.2 V, is very low at approximately 22° C.

The advantages of the transformer designed according to the present invention are as follows in particular: inexpensive winding design and manufacture; no additional retaining clamps needed for the winding body and ferrite core; the width of the winding is reduced, so that coupling is adapted to the control unit; coupling of the individual windings is designed so that it is optimally adapted to the control unit and only a low power loss is produced there and on the whole; intrinsic heating is very low and is largely the same in the core and winding package; efficiency is very good at more than 90%; and due to the proper design, control units for more severe operating conditions are possible.

What is claimed is:

1. A transformer device for use in an isolating transformer power supply circuit, the transformer device comprising:

a divided primary winding including at least three partial primary windings;

a divided secondary winding including at least two partial secondary windings, the secondary winding having a load for a time period, each of the at least two partial secondary windings being enclosed by two of the at least three partial primary windings;

a magnetic core having an air gap;

a bobbin surrounding the magnetic core, the divided primary winding and the secondary winding being coupled to the bobbin; and terminal posts arranged in at least one row and connected to the divided primary winding and the divided secondary winding.

2. The transformer device according to claim 1, wherein the at least three partial primary windings are coupled in parallel and externally to the transformer device.

3. The transformer device according to claim 1, wherein the at least two partial secondary windings are connected in parallel in the transformer device.

4. The transformer device according to claim 1, wherein the transformer device is arranged for use in a power supply circuit of a high-pressure gas discharge lamp, the high-pressure gas discharge lamp being a part of an automotive headlight.

5. The transformer device according to claim 1, wherein turns of the divided primary winding and the divided secondary winding are arranged in a transformer area that excludes an area above the air gap.

6. A transformer device for use in an isolating transformer power supply circuit, the transformer device comprising:

a divided primary winding including at least three partial primary windings;

a divided secondary winding including at least two partial secondary windings, the secondary winding having a load for a time period, each of the at least two partial secondary windings being enclosed by two of the at least three partial primary windings;

a magnetic core having an air gap;

a bobbin surrounding the magnetic core, the divided primary winding and the secondary winding being coupled to the bobbin;

terminal posts arranged in at least one row and connected to the divided primary winding and the divided secondary winding; and at least one further secondary winding arranged in the transformer device and outside an interleaving area of the divided primary winding and the divided secondary winding.

7. The transformer device according to claim 6, wherein first leads of the divided primary winding, second leads of the divided secondary winding, and at least one third lead of the at least one further secondary winding are attached to a first bobbin side of the bobbin and wherein first ends of the divided primary winding, second ends of the divided secondary winding and at least one third end of the at least one further secondary winding are attached to a second bobbin side of the bobbin.

8. The transformer device according to claim 7, wherein the the at least three partial primary windings having at least three first leads and at least three first ends, the at least two partial secondary windings having at least two second leads and at least two second ends and the at least one further secondary winding having at least one third lead and at least one third end, each of the leads and the ends being attached to the terminal posts, a first row of the terminal posts being positioned on the first bobbin side and a second row of the terminal posts being positioned on the second bobbin side so that the transformer device is protected against a polarity reversal, a first number of the terminal posts in the first row being equal to a second number of the terminal posts in the second row.

9. The transformer device according to claim 8, wherein the transformer device is arranged for use in at least one of a testing instrument and a circuitboard.

10. The transformer device according to claim 6, wherein a size of the magnetic core, a first electric resistance of the divided primary winding, a second electric resistance of the divided secondary winding and a third electric resistance of the at least one further secondary winding applied to the bobbin are preselected so that thermal losses in the magnetic core, the divided primary winding, the divided secondary winding and the at least one further secondary winding result in heating of the magnetic core and the divided primary winding, the divided secondary winding and the at least one further secondary winding such that a temperature difference between a first temperature of the magnetic core and a second temperature of the divided primary winding, the divided secondary winding and the at least one further secondary winding is negligible.

11. The transformer device according to claim 6, wherein first turns of the divided primary winding, second turns of the divided secondary winding and third turns of the at least one further secondary winding are arranged in a transformer area that excludes an area above the air gap.

12. The transformer device according to claim 11, wherein the bobbin includes a first chamber and a second chamber, the first chamber being separate from the second chamber by a partition over the transformer area.

13. The transformer device according to claim 12, wherein a first width of the first chamber, a second width of the second chamber, a diameter of a winding wire, a first number of turns of the at least three partial primary windings and a second number of turns of the at least two partial secondary windings are preselected so that a complete layer is assigned to a corresponding partial winding and the first chamber and the second chamber are entirely occupied.

14. The transformer device according to claim 12, wherein the divided primary winding, the divided secondary winding and the at least one further secondary winding are wound using at least one of a winding wire composed of a single wire gauge and a winding wire composed of a stranded conductor material.

15. The transformer device according to claim 12, wherein the partition includes at least one passage for a winding wire of the divided primary winding, the secondary winding and the at least one further secondary winding extending from the first chamber into the second chamber.

16. The transformer device according to claim 15, wherein a first part of each of the at least three partial primary windings and each of the at least two partial windings is arranged on a first side of the transformer area in the first chamber, and a second part of each of the at least three partial primary windings and each of the at least two partial secondary windings is arranged on a second side of the transformer area in the second chamber.

17. The transformer device according to claim 16, wherein a first part is a first half and a second part is a second half.

* * * * *

UNITED STATES PATENT AND TRADEMARK OFFICE

CERTIFICATE OF CORRECTION

PATENT NO. : 6,150,914
DATED : November 21, 2000
INVENTOR(S) : Borho et al.

It is certified that error appears in the above-identified patent and that said Letters Patent is hereby corrected as shown below:

Abstract
Line 5, change "... it, the transformer..." to -- it. The transformer --.
Line 8, change "The, ..." to -- The --.

Column 1,
Between lines 8 and 9, insert -- BACKGROUND INFORMATION --.

Column 2,
Line 22, change "...ememplary..." to -- exemplary --.

Signed and Sealed this

Eleventh Day of September, 2001

*Attest:*

Nicholas P. Godici

*Attesting Officer*

NICHOLAS P. GODICI
*Acting Director of the United States Patent and Trademark Office*